United States Patent [19]

Huff

[11] 4,452,595

[45] Jun. 5, 1984

[54] STRIPPER APPARATUS FOR PAPERBOARD BLANKS

[75] Inventor: Richard J. Huff, Norwich, Conn.

[73] Assignee: Federal Paper Board Company, Inc., Montvale, N.J.

[21] Appl. No.: 339,873

[22] Filed: Jan. 18, 1982

[51] Int. Cl.[3] ..... B31B 1/74

[52] U.S. Cl. ..... 493/83; 493/373

[58] Field of Search ..... 493/83, 82, 373, 342; 83/103

[56] References Cited

U.S. PATENT DOCUMENTS

| | | | |
|---|---|---|---|
| 3,055,275 | 9/1962 | Schroter | 493/373 |
| 3,249,272 | 5/1966 | Scarpa | 493/342 X |
| 3,784,070 | 1/1974 | Vossen | 493/342 X |
| 4,175,477 | 11/1979 | Inose et al. | 493/373 X |
| 4,175,686 | 11/1979 | Lang | 493/373 X |
| 4,248,370 | 2/1981 | Schröter | 493/82 X |

*Primary Examiner*—James F. Coan

*Attorney, Agent, or Firm*—James T. FitzGibbon

[57] ABSTRACT

An improved mounting system for stripper pins used in separating pre-cut areas from folding carton blanks. A system of rails, tracks, holders and brackets is provided which facilitates easy adjustment of the stripper pin location and reduces preparation time. An important feature is that the horizontal surfaces of the pin mounting brackets are of minimal area so as to prevent accumulation of scrap pieces separated from paperboard blanks from accumulating on the pin brackets and tracks. This minimizes manual clean-up work and press downtime.

9 Claims, 10 Drawing Figures

STRIPPER APPARATUS FOR PAPERBOARD BLANKS

The present invention relates generally to specialty machines, and more particularly, to so-called stripper assemblies for use in separating or "stripping" pre-cut pieces of scrap from selected areas of paperboard sheets during formation of paperboard blanks used to make bottle carrier cartons, display cartons or other paperboard packages.

An important part of the paperboard industry is devoted to the manufacture of paperboard blanks from which folding cartons or wraparound cartons and carriers are made. Customarily, in this industry, a large sheet of paperboard is subdivided by cuts into a number of individual blanks, and these blanks are then erected and filled with merchandise or are wrapped around a group of articles, such as bottles or cans, to form a combination package and carrier for these products.

During manufacture, it is desired to deal with large paperboard sheets as a whole instead of completely separating them from one another, and while many openings must be made in the blanks, it is not desired to create scrap on the cutting table where the cuts are made. Therefore, the openings are formed by being cut almost all the way through at the cutting location, and leaving cut out portions, which will become pieces of scrap adhered to the remainder of the sheet by thin, spaced apart webs of uncut material.

Likewise, the individual carton blanks are separated from each other but still held in place by small uncut areas. After the sheets have been precut in this manner, converting them to individual carton blanks involves the process of "stripping", that is, removing pices of scrap from selected areas of the sheets. After this process, the individual blanks are then separated from each other and erected or wrapped around the product in question. The openings are incorporated into the finished carton for increased visibility of the product for receiving fingers, for receiving locking tabs, and for other known reasons.

The present invention relates to simplified and improved stripping apparatus for removing these pieces of scrap from selected areas of these paperboard blanks during manufacture, that is, after the blanks have been precut and before they are separated from the sheets and from each other.

It is well known in the art that this stripping is accomplished by passing individual rectangular sheets of paperboard from the cutting area, or from a storage area disposed downstream of the cutting area, onto a specially prepared stripper table. This table usually has a surface made from a thin supporting material, such as plywood or the like, adapted to support a sheet from which blanks are cut. The table, unlike an ordinary table, however, is cut so as to have openings therein which correspond to and register with the openings intended to be made in the array of blanks. Consequently, when a paperboard sheet is fed onto the stripper table, the sheet is positioned as desired and the plural openings in the table are positioned in registry with the portions of the blank intended to be removed therefrom before the sheet is picked up and moved to the next station.

In the prior art, problems have arisen with stripping apparatus, which problems have created a number of drawbacks in the industry. As with other mass production industries, the manufacture and feeding of folding cartons, in order to be practical, must be achieved at very high speeds. These speeds can be achieved only if the apparatus is able to run at a satisfactorily high cyclic rate, and more importantly, only if the apparatus can continue to function over a relatively long period. In other words, a fast running machine is of no value if the machine can only run for a matter of a few moments before being required to stop for maintenance or cleaning.

In the past, stripping apparatus has been characterized by a tendency to become clogged with the pieces being stripped from the blanks. This necessitates stopping the entire line and removing the scrap material from the machine before re-initiating the production cycle. In the prior art, this has occured mostly because, in the areas beneath the stripper table, the stripper pins were supported by a mechanism which occupied an unduly large below-table area. Consequently, the scrap pieces generated by removal from the blank tended to accumulate on the pin supports occupying these areas. The present invention is directed to a simplified stripper pin positioning and locking mechanism which is free from areas of significant size wherein scrap can accumulate, and is therefore essentially self-cleaning.

In prior art stripper apparatus, a pair of cooperating articles referred to as stripper pins are mounted respectively above and below the stripper table. Stripping itself is accomplished when, by means of a known mechanism, upper and lower, oppositely directed pairs of stripper pins are moved into simultaneous engagement with the strippable portions of the blank from above and below the blank, pinching the scrap section between the upper face of the lower pin and the lower face of the upper pin. Thereupon, the stripper pins, as a pair, undergo a downward movement serving to pull the scrap pieces from the blank. Thereafter, while both pins are below the table, the upper pin moves upwardly relative to the lower pin to free the piece of scrap thus stripped and permit them to drop by gravity from beneath the table which supports the paperboard sheet. Thereupon the upper and lower pins are withdrawn to their relatively remote initial positions while the paperboard sheet is removed from the stripper table, and while another sheet is inserted and indexed into the proper position. Thereafter, the cycle is repeated as the upper and lower pins converge upon each other and pinch the scrap pieces between their opposed faces, pulling them downwardly to separate them and their opening to release the pieces of scrap from between the pin faces.

In the past, in an attempt to make stripper pin assemblies more adjustable, and hence more universal, the structures had grown to the point where they occupied considerable space beneath the table; it was the provision of the pin support mechanisms in these units which has created the clogging problem commonly characterizing such machines. This complexity also made them considerably more costly.

In the industry, it is desirable to make stripper pin supports adjustable along two axes so that, as each different carton blank or the like is fed to the table, the stripper pins may be adjusted so as to register with their associated openings. Thus, the vertical motion of the upper and lower stripper pins remains the same for any blank, but the pins are positioned relative to the openings which are located in any one associated stripper table plate. Thus, if a blank having fifty openings in a predetermined area is being dealt with, the associated stripper table will have openings for each of these blanks. After a run of this product is made, another plywood stripper table top is placed in a "make ready" table where the upper and lower stripper pin sets are adjusted so that each pair of pins will, in use, coincide vertically when the stripping mechanism is actuated.

According to the present invention, a simplified arrangement of stripper bars, supports and brackets is provided which will allow complete, universal adjustment of a simplified nature, and which will be free from offset support arms or legs which occupy so much below table space that scrap disposal is difficult.

In view of the shortcomings of the prior art, it is an object of the present invention to provide an improved stripper apparatus.

Another object of the invention is to provide a stripper assembly which includes a simplified set of bars, brackets and other mounts for paperboard stripping pins.

A further object of the invention is to provide a stripper apparatus which is much easier than prior art apparatus to set up, and which in use will provide greatly decreased retention of scrap pieces stripped from paperboard blanks.

A still further object of the invention is to provide an improved universal mount for stripper pin pairs.

Yet another object of the invention is to provide a stripper assembly which includes positioning tracks, brackets, and pin mountings which are of greatly reduced cost in relation to prior art stripper bars.

Another object is to provide a stripper pin assembly which, in relation to prior art units, is much less prone to clogging and scrap accumulation.

A further object of the invention is to provide a stripper pin mounting assembly which is reliable and economical in use.

A still further object of the invention is to provide a stripping apparatus which is simplified and easier to manufacture, easier to install and easier to manipulate during set up than prior art stripper units, and which does not require a pre-make ready table for set-up operations.

Yet another object is to provide a stripper apparatus which includes a plurality of stripper support track units having vertical and horizontal flanges, plural elongated slots in one of the flanges, wherein brackets are associated with these supports, and wherein each bracket is adapted to be positioned by cap screws or the like to the pin support on one flange thereof and to the stripper pin assembly in the other flange.

The foregoing and other objects and advantages of the invention are achieved in practice by providing a stripper apparatus which includes a frame assembly, a plurality of stripper tracks positionably associated with the frame, a plurality of pin support brackets associated with each track and a stripper pin and pin fastener associated with each bracket, with each of the tracks having elongated longitudinal slots, and with each support bracket being of minimum width and arranged for adjustable association with said track and for ready positioning of said pin assembly.

The manner in which the foregoing and other objects and advantages of the invention are achieved in practice will become more clearly apparent when reference is made to the following detailed description of the preferred embodiments of the invention set forth by way of example, and when reference is made to the accompanying drawings, in which like reference numbers indicate corresponding parts throughout the several figures.

DESCRIPTION OF THE PREFERRED EMBODIMENTS OF THE INVENTION

Figure 1:
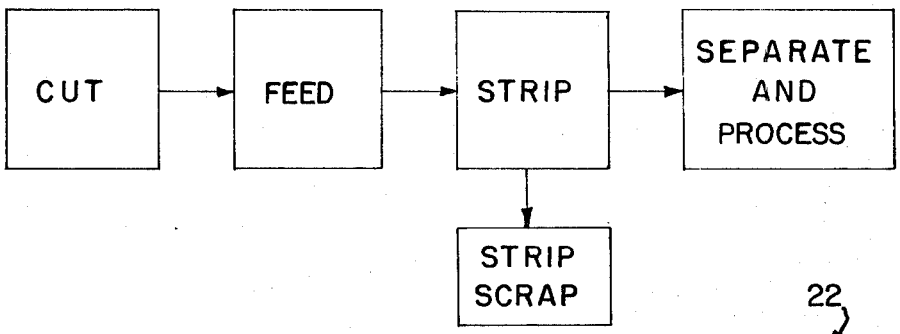
FIG. 1 is a block diagram showing the steps comprising a stripping operation carried out, at least in part, by the improved apparatus of the invention.

Referring now to the drawings in greater detail, FIG. 1 shows a block diagram or flow chart of the method of stripping scrap which advantageously embodies the improved apparatus of the invention. Thus, as shown in FIG. 1, the first step comprises cutting, and in some cases decorating, sheets of paperboard so as to form the outlines of one or more blanks for each sheet. In this operation, the blanks are cut almost through where scrap is to be removed and where individual blanks are separated from each other; however, small webs or uncut areas of board remain to hold the sheet from coming apart when processed. The blanks also commonly include fold or score lines, interrupted cut lines and the like, which are useful in the finished product.

After the decorated sheets have been moved to the vicinity adjacent the stripper apparatus, they are cut and scored by an apparatus of a conventional type. Thereafter, as diagramatically shown in FIG. 1, the sheets are moved, one by one, on to a stripper table wherein they are placed in a desired position of registry with the stripper table. The sheets are advanced for movement from the cutting and scoring area to the stripper area and beyond, the leading edges of the sheet are gripped by a chain mount mechanism to which reference is made elsewhere herein. At the stripper table, pairs of stripper pins move together to engage the individual pieces of scrap to be removed from the sheet, and after the pieces are firmly pinched between the end faces of opposed pins, the pins then move downwardly while being held together, out of and below the plane of the sheet and the table top. Thereafter, the pins move apart to release the scrap held therebetween, and the scrap pieces fall freely from the blanks. Thereafter, the individual sheets are advanced from the stripper table to another stack area, with the scrap completely separated from them. Thereafter the stripped sheets are sent to packaging machines where they are separated into individual blanks and fed to their associated erecting and/or wrapping machinery.

Figure 2:
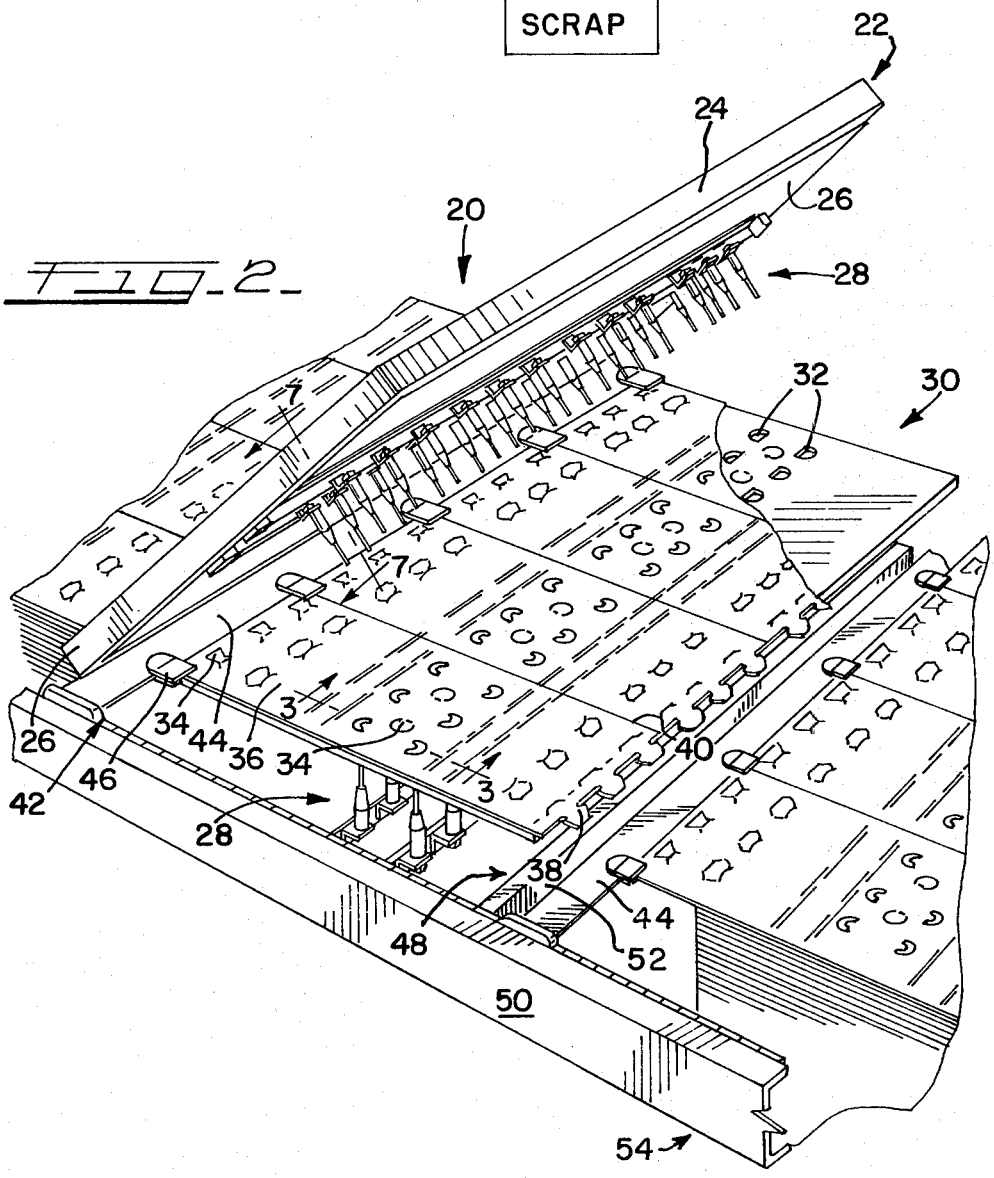
FIG. 2 is a perspective view, with portions broken away, showing the novel stripper pin support and adjustment apparatus of the invention, the stripper table and the relation of the die cut sheets to the process apparatus.

FIG. 2 shows certain details of a stripper apparatus generally designated 20, and shown to include an upper frame assembly 22 comprising a pair of upper side rails 24 and a pair of opposed end rails 26. A plurality of stripper pin assemblies 28 are supported with respect to the frame 22 in a manner to be described in detail later. Situated beneath the upper frame is a table 30 having a plurality of apertures 32 therein, with the apertures being aligned or in position of registry with the apertures 34 in a sheet 36 of paperboard lying on the table. In the embodiment shown, the paperboard sheet 36 includes an outer margin defined by tabs 38, which will form locks with the selected openings 34, and is further shown to include cut lines 40 which extend transversely of the sheet and serve to subdivide it into a plurality of individual blanks. The intermediate portion of the apparatus 42 includes a rail 44 on which a plurality of transfer clips 46 are situated; these ride on chains 47 and engage the leading edges of each sheet as it moves into the position on the stripper table in a manner known to those skilled in the art. Beneath the stripper table 30 is a lower frame generally designated 48 and shown to include a pair of end rails 50, (one only shown in FIG. 2) and side rails 52 (one only shown in FIG. 2). A plurality of pin assemblies 28 are also shown to be positioned in the lower frame in a manner to be described. These parts are mounted in a manner known to those skilled in the art for reciprocation with respect to the main frame 54 of the entire stripper apparatus.

Figure 3:
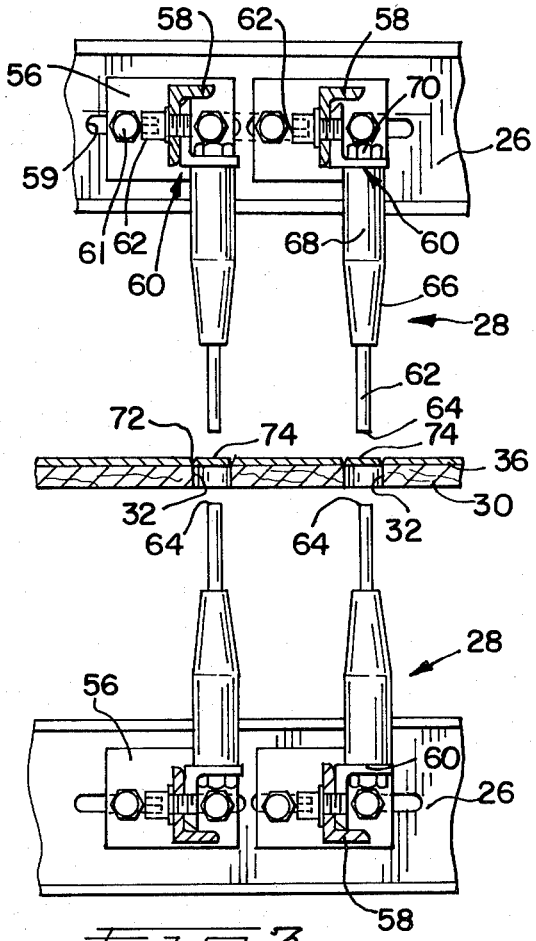
FIG. 3 is a vertical sectional view, on an enlarged scale, showing the upper and lower stripper pin pairs in spaced apart relation.
Figure 4:
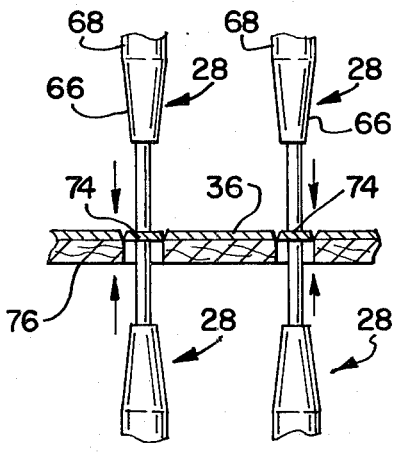
FIG. 4 is a view similar to FIG. 3, showing the relation of the stripper pins and their supports relative to the table and the paperboard sheet in the closed position of the stripper apparatus.
Figure 5:
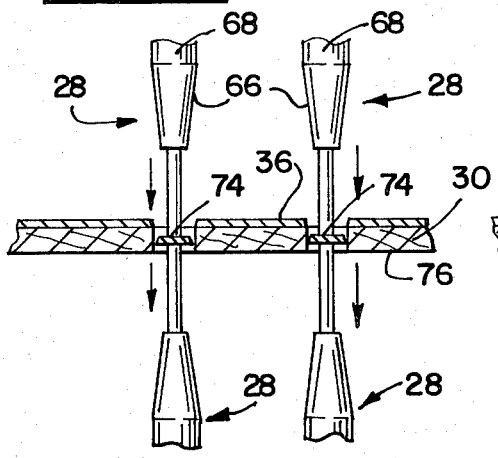
FIG. 5 is a view similar to that of FIG. 4, showing the pin pairs as they travel downwardly to strip cut pieces of scrap from the die cut sheet.

Referring now to FIGS. 3–5, certain components of the apparatus and the manner of using it are illustrated. Here, an upper frame end rail 26 is shown to include a pair of track mounting brackets 56 to which a pair of transversely extending, pin mounting tracks 58 are secured. The brackets 56 extend to either side of the tracks 58, as shown, and are adjustably positionable in slots 59 which extend lengthwise of the end rails 26. Movement of these brackets, and positioning of tracks 58 is accomplished by loosening the fasteners 61, moving the brackets 56, and then tightening the fasteners 61. Each mounting track is shown to have associated with it a pin support bracket 60 secured by a fastener 62. Details of these units are set forth elsewhere herein.

The pin assembly itself, designated 28 in FIG. 3, is shown to include a pin 62 in the form of a cylindrical rod having an perpendicular end face 64, and to be supported by a neck portion 66 lying between the shank 68 and the neck 66 of the pin assembly 28. The shank 68 is positioned by a fastener 70 with respect to the pin support bracket 60. The lower assembly is in FIG. 3 is identical to that described above and includes the end rail 26, and the various brackets 56, 60 for mounting the track 58 and the pin assemblies 28. As shown in FIG. 3, the end faces 64 of the lower pin assembly are opposed facing relation to their counterparts on the upper assembly. The table 30 which typically is made from plywood or the like is shown to have the openings 32 of the type referred to above. As shown in FIGS. 3 and 4, the lines of weakness 72 defining their cut lines or other lines of weakness defining the individual pieces 74 of scrap which are to be removed by the apparatus of the invention. As pointed out the sheet 36 of paperboard lies in position atop the table 30 where it is secured during stripping.

Figure 6:
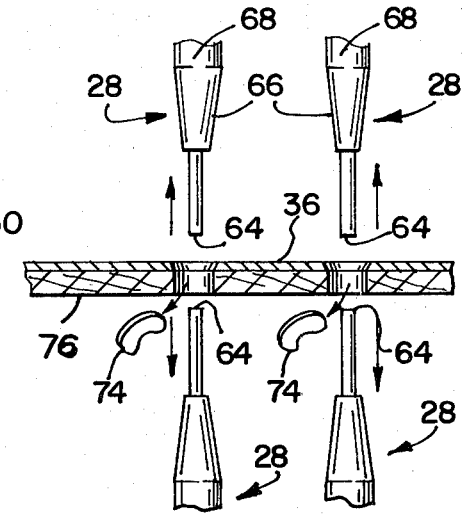
FIG. 6 is a view similar to FIGS. 4 and 5, and showing the pins releasing the scrap and beginning to return to their initial positions.

Referring now to FIG. 4, the arrows indicate that the upper and lower stripper pin assemblies 28 move towards each other and engage between their end faces 64 the section 74 of paperboard to be removed. After the board is pinched as shown in FIG. 4, the pin assemblies 28 and their associated support tracks and brackets move downwardly as a unit, as shown in FIG. 5, to pull the scrap pieces 74 through the apertures 32 in the table 30. Thereafter, when the end faces 64 of the lower pins lie beneath the lower surface 76 of the table 30 (FIG. 6), the upper sets of pins 28 rise to permit the pieces 74 of scrap to fall by gravity from the pins. Thereafter, the lower pins 28 remain in this position, which then becomes the position of FIG. 3, until the cycle is ready to be repeated.

Figure 7:
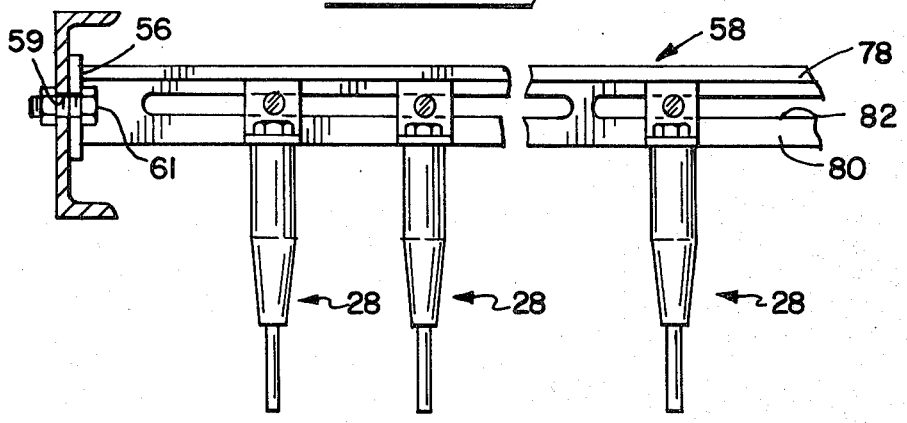
FIG. 7 is a side elevational view, with portions in section and with portions broken away, showing the construction and arrangement of the stripper pin support and positioning assembly in relation to the frame and end rails of the unit.
Figure 8:
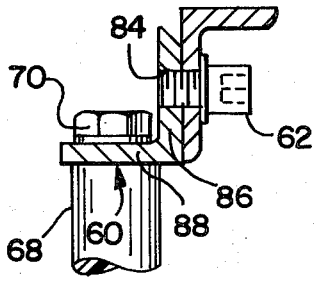
FIG. 8 is an enlarged view, partly in elevation and partly in vertical section, showing further details of the stripper pin tracks and brackets.

Referring now to FIG. 7, additional constructional details of the assembly are shown. Here, more details of the positioning and adjusting system for the pin assemblies 28 are shown. As shown, if mounting track 58 contains a horizontal flange 78, a vertical flange 80 and a plurality of elongated slots 82 defined by inwardly directed margins of the vertical flange 80. The fasteners 62 (FIG. 8) are preferably socket ahead cap screws and, as also shown in FIG. 8, there are preferably a tapped openings 84 in the vertical leg 86 of each pin holder bracket 60. Because of the length of the slot 82, it is easy to adjust the individual pin support brackets 60 to desired positions of use. The track mounting bracket 56 is also adjustable so that the pin assemblies 28 may be moved either laterally or longitudinally.

An important feature of the invention is that the horizontal flange 88 of the pin mounting bracket 60 is only large enough to support the pin support shank adequately and to provide for snug installation of the fastener 70. In prior art systems, a large horizontal element corresponding to the flange 88 was provided in an attempt to obtain a greater range of adjustment, but such units, when used as the lower brackets caused undesirable accumulation of scrap. Consequently, the overall width of the horizontal flange 88 of the pin support bracket 60 is desirably no greater than about $1\frac{1}{2}$ times the overall diameter of the pin shank 68, and in any case, it is designed so as to present the minimum surface area lying outside the area covered by the end face of the shank 68 of the pin support assembly 28.

In FIGS. 7–10, upper support units are shown, but both upper and lower units being identical, it will be understood that it is the lower unit which is required to be compact and that it is desirable, but not absolutely necessary, that the upper assemblies be a similar or identical configuration.

Figure 9:
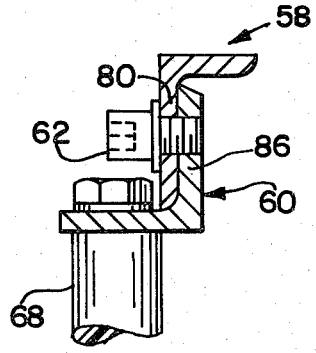
FIG. 9 is a view similar to FIG. 8, but showing the parts in another position of use.
Figure 10:
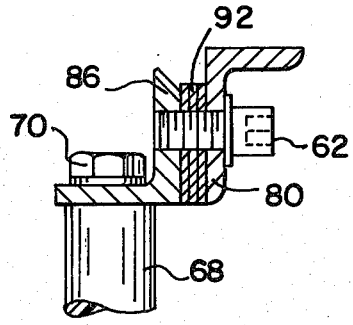
FIG. 10 is a view similar to FIGS. 8 and 9 and showing the pins in a still further position of possible adjustment.

FIGS. 9 and 10 show alternate embodiments of the invention, with FIG. 9 showing that the positioning fastener 62 for the pin support bracket 60 is reversed and that the vertical flange 86 of the pin support lies on the other side of the flange 80 of the mounting track 58. Reversing the flanges are sometimes useful when it is not necessary to move the track 58 as a whole.

FIG. 10 is similar to FIG. 8, except that it shows several shims 92 disposed between the flanges 80 and 86 on the track 58 and bracket 60. Other positions may likewise be used.

Compared to the prior art, the present invention is not only much more economical, but it is also much easier to set up. In prior art pin stripping units, the remote positioning of the pin relative to the track caused the make-ready operation to involve more labor and take more time. Moreover, the support holders were arranged in an attempt to achieve adjustability in such a way that they could not be positioned as closely together as with the present system. This is important for a number of folding cartons. Because the present system is very low in cost, it is possible to remove the upper and lower frames as a whole after they have been set up for a particular job, use the cutting and stripping apparatus on another job, and when returning to blanks of the kind previously made, merely replace the frames and their pins in positioning supports. This was not possible in the prior art, because of the expense of prior art positioners for stripping pins.

In use, a very important advantage is the elimination of scrap build-up on the cross members, because as pointed out, this requires stopping the entire operation and manual cleaning of the pin assemblies. Because of its simplicity, the present invention also eliminates the need for a premakeready pin stripper table, which costs approximately $30,000.00 and which is required with prior art constructions. The elimination of this premakeready table for offpress use streamlines operations and minimizes downtime for the machine.

It will thus be seen that the present invention provides an improved stripping apparatus for paperboard sheets having a number of advantages and characteristics including those pointed out above and others which are inherent in the invention. A preferred embodiment of the invention having been described by way of illustration, it is anticipated that changes and modifications of the described stripping apparatus will occur to those skilled in the art and that such changes and modifications may be made without departing from the spirit of the invention or the scope of the appended claims.

I claim:

1. An apparatus for stripping precut portions of paperboard from a paperboard sheet supported on an apertured table unit, the apertures in said apertured table unit being constructed and arranged so as, in position of use, to be in respective positions of registry with waste portions precut but not separated from said paperboard sheet, said stripping assembly comprising, in combination, upper and lower pin support frames, each of said frames including a pair of opposed end rails, a plurality of elongated pin mounting tracks being secured at their respective ends to said end rails, each of said tracks having inwardly directed margins defining elongated slots in said tracks, a plurality of pin support brackets associated with each mounting track, each of said tracks having associated therewith a fastener for each pin support bracket, each of said pin support brackets having a fastener for affixing a pin assembly thereto, and a pin assembly associated with each of said pin support brackets, each of said pin assemblies comprising a pin support having a shank portion, a neck portion and a pin extending axially outwardly of one end thereof, and having means on the other end thereof for receiving said pin support fastener, each of said pins being of generally cylindrical form and having a substantially flat end face portion adapted to engage one surface of said precut portions on said paperboard sheet, said mounting tracks and pin support brackets and their associated fasteners being arranged so that the position of said upper and lower pin assemblies may be adjusted with respect to said tracks to a plurality of vertically registered positions, whereby said end faces of said pins may be moved in use toward and away from positions of engagement with the paperboard lying in said precut areas to grip said precut areas therebetween, said upper and lower frames being mounted for reciprocation with respect to each other and also for reciprocation as a unit to grip said precut areas, removing them from the plane of said table and then release them, said pin support brackets and said mounting tracks each being of generally L-shaped cross section, and comprising vertical and horizontal flange portions and being arranged in position of use with said respective vertical flange portions on said support brackets lying along said vertical flange portions of said support tracks, said horizontal flange portions of said pin support brackets having an area not more than twice to three times the end face area of said shank portion of said pin assembly to present minimal surface area for retention of scrap paperboard taken from said precut area.

2. An apparatus as defined in claim 1 wherein said pin mounting tracks include end brackets securing said tracks to said end rails, one of said end rails and said brackets including elongated slots to permit adjustable positioning of said tracks.

3. An apparatus as defined in claim 1 wherein the horizontal extent of said flange on said pin support bracket is less than twice the diameter of said shank of said pin assembly.

4. An apparatus as defined in claim 1 wherein said vertical flanges of both said support track and said support brackets are constructed and arranged so that said support bracket flange may be fastened to said track flange on either side thereof.

5. An apparatus as defined in claim 1 wherein said horizontal and vertical flange portions of said support track and said support bracket are constructed and arranged so that said bracket may be fastened to said track with said horizontal flange portion of said bracket lying to either side of said vertical flange of said track.

6. An apparatus as defined in claim 1 wherein said assembly includes a plurality of shims disposed between at least some of the vertical flanges on said support track and the vertical flange on said support brackets.

7. An apparatus as defined in claim 1 in which said support track assemblies and said support bracket assemblies associated with said upper pin support frame are substantially identical with those of said lower pin support frame.

8. An improved mounting arrangement for portions of a pin stripping apparatus, said apparatus including upper and lower frame units and an apertured table unit lying between said frame units and adapted to lie beneath and support a paperboard sheet in which apertures have been precut but not separated from said paperboard sheet and to be positioned so that said sheet and table apertures are in registry with each other, said improved mounting arrangement comprising, in combination, a plurality of upper and lower pin mounting tracks, said upper tracks lying parallel to each other and said lower tracks lying parallel to each other, each of said tracks having a plurality of elongated slots, a plurality of pin support brackets associated with at least some of said tracks, said brackets including vertical and horizontal flanges with said vertical flanges being adapted to receive fasteners passing through said slots in said tracks for adjustable positioning of said brackets, said horizontal flange of said brackets including an opening extending vertically therethrough and receiving a fastener for positioning an associated stripping pin assembly, a stripping pin assembly associated with each of said support brackets, said pin assembly having means on one end for receiving said fasteners, a shank portion and a pin portion having a flat end face forming one end thereof with the other end of said pin being received in said shank, said horizontal flange of said pin supporting bracket being constructed and arranged so that said width and length of said horizontal flange are less than one and one-half times the diameter of said shank of said pin assembly.

9. An apparatus as defined in claim 8 which further includes track mounting brackets operatively associated with the ends of said upper and lower pin, said track mounting brackets having means thereon permitting said ends of said mounting tracks to be moved transversely of the longitudinal axes of said tracks.

* * * * *